US007497087B2

(12) United States Patent
Molfese

(10) Patent No.: US 7,497,087 B2
(45) Date of Patent: Mar. 3, 2009

(54) LIQUID COOLER APPARATUS

(76) Inventor: Philip Molfese, 709 79th St., Unit 401, Darien, IL (US) 60561

( * ) Notice: Subject to any disclaimer, the term of this patent is extended or adjusted under 35 U.S.C. 154(b) by 191 days.

(21) Appl. No.: 11/673,654

(22) Filed: Feb. 12, 2007

(65) Prior Publication Data

US 2008/0098767 A1 May 1, 2008

Related U.S. Application Data

(62) Division of application No. 10/073,821, filed on Feb. 11, 2002, now Pat. No. 7,174,723.

(60) Provisional application No. 60/268,172, filed on Feb. 12, 2001.

(51) Int. Cl.
*F25D 25/00* (2006.01)
*F25D 13/06* (2006.01)
*F25D 3/08* (2006.01)
*F25D 25/02* (2006.01)

(52) U.S. Cl. ..... 62/62; 62/63; 62/293; 62/372; 62/381

(58) Field of Classification Search ..... 62/62, 62/63, 293, 372, 379, 381, 457.2, 457.4, 62/457.5

See application file for complete search history.

(56) References Cited

U.S. PATENT DOCUMENTS 4,164,851 A * 8/1979 Bryant ..... 62/381
4,549,409 A * 10/1985 Smith ..... 62/381
4,580,405 A * 4/1986 Cretzmeyer, III ..... 62/63
5,361,604 A * 11/1994 Pier et al. ..... 62/457.4
5,505,054 A * 4/1996 Loibl et al. ..... 62/63
5,845,501 A * 12/1998 Stonehouse et al. ..... 62/62
6,314,751 B1 * 11/2001 Gjersvik ..... 62/457.4
6,378,313 B2 * 4/2002 Barrash ..... 62/6
6,397,624 B1 * 6/2002 Horwell ..... 62/457.8
6,449,958 B1 * 9/2002 Foye ..... 62/3.2

* cited by examiner

*Primary Examiner*—Chen-Wen Jiang

(57) ABSTRACT

A liquid cooler is disclosed that includes a housing and at least two heatsinks attached with the housing. The heatsinks each include a top wall with an inwardly facing wall, a bottom wall with an inner surface, interior sidewalls and an interior lower wall. The inner surface is formed to surround and contact a portion of an outer surface of a container. The inwardly facing wall, the interior sidewalls, and the interior lower wall define a cavity. The interior lower wall of the cavity includes at least one heat fin. An outer covering is included and surrounds the heatsink. A method of rotation is provided to rotate the heatsink and the outer covering.

19 Claims, 10 Drawing Sheets

LIQUID COOLER APPARATUS

CROSS REFERENCE TO RELATED APPLICATIONS

This application is a continuation (divisional) of co-pending U.S. patent application Ser. No. 10/073,821, filed Feb. 11, 2002, which claims the benefit of priority to U.S. Provisional Application No. 60/268,172, filed Feb. 12, 2001. This divisional application incorporates by reference and claims the benefit of priority to both prior applications.

FIELD OF THE INVENTION

This invention relates generally to cooling devices, and more specifically to a cooling device that will rapidly cool the contents of a liquid container.

BACKGROUND

Rotating a container of liquid about its longitudinal axis while the container is within a bucket of ice can cool the container of liquid. Furthermore, cooling is effected more quickly as the speed of rotation is increased. However, holding and rotating a container while it is disposed in ice can cause the container to tear or fracture due to the sharp edges which may be present on the ice. Furthermore, manually handling the container may be awkward.

This situation has prompted others to manufacture devices to effect the rapid chilling of beverages in containers. Some of these devices cool beverages by rotating a container that is in direct contact with a cold substance. However, this will often cause the container to get soiled and be more difficult to handle. Additionally, some of these beverage coolers are awkward to handle and difficult to store.

Still other container coolers are designed for either bottles or cans exclusively, and not for both. For example, U.S. Pat. No. 2,216,762, issued to Bolas, discloses a mechanism to rotate a bottle of wine inserted into an ice bucket and is specifically limited to bottles. U.S. Pat. No. 3,316,734, issued to Crane, discloses an apparatus for cooling canned liquids and is specifically limited to cans.

BRIEF SUMMARY

A liquid cooler is provided herein. The liquid cooler includes a housing and at least two heatsinks attached with the housing. The heatsinks each includes a top wall with an inwardly facing wall, a bottom wall with an inner surface, interior sidewalls and an interior lower wall. The inner surface is formed to surround and contact a portion of an outer surface of a container. The inwardly facing wall, the interior sidewalls, and the interior lower wall define a cavity. The interior lower wall of the cavity includes at least one heat fin. An outer covering is included and surrounds the heatsinks. A method of rotation is provided to rotate the heatsinks and the outer covering.

In another aspect of the invention, the liquid cooler includes a housing and a block attached with the housing. The block has an inner surface that defines a space. The block is configured so that the space is able to receive a container, and a method of rotation is provided to rotate the block.

In another aspect of the invention, the liquid cooler includes a housing and at least one heatsink attached with the housing. The heatsink includes a flexible membrane and interior sidewalls. The membrane is formed to surround and contact a portion of an outer surface of a container. The interior sidewall and the membrane define a cavity. A cooling substance is provided and contained within the cavity. The liquid cooler also includes an outer covering that is attached with the housing and surrounds the heatsink. A method of rotation is provided to rotate the heatsink and the outer covering.

Another aspect of the invention provides a refrigerator-freezer having a freezer door including a liquid cooler for cooling a container. The liquid cooler includes a housing and at least one heatsink attached with said housing. The heatsink has a top wall with an inwardly facing wall, a bottom wall with an inner surface formed to surround and contact a portion of an outer surface of the container, interior sidewalls and an interior lower wall. The inwardly facing wall, interior sidewalls, and interior lower wall define a cavity. The interior lower wall of the cavity includes at least one heat fin. The liquid container further includes an outer covering attached with the housing that surrounds the heatsink, a pushbutton for rotating the heatsink and the outer covering, and an ejector button for removing the container from the heatsink.

The invention also embodies a method of rapidly chilling liquids within containers. The method includes providing a liquid cooler having a housing, at least one cold heatsink, and a container receiver. A 12-ounce container is placed into the container receiver. The container receiver is rotated, and the container is cooled from approximately 80 degrees F. to approximately 40 degrees F. in less than one minute. The container is then removed from the container receiver.

The invention also embodies a method of promoting the sale of liquid coolers. At least one liquid cooler having a container receiver is distributed. The liquid cooler is then incorporated into a device. A container is placed into the container receiver. The container receiver is rotated, and the container is cooled from approximately 80 degrees F. to approximately 40 degrees F. in less than one minute. The container is then removed from the container receiver.

The foregoing and other features and advantages of the invention will become further apparent from the following detailed description of the embodiments, read in conjunction with the accompanying drawings.

DETAILED DESCRIPTION

Figure 1:
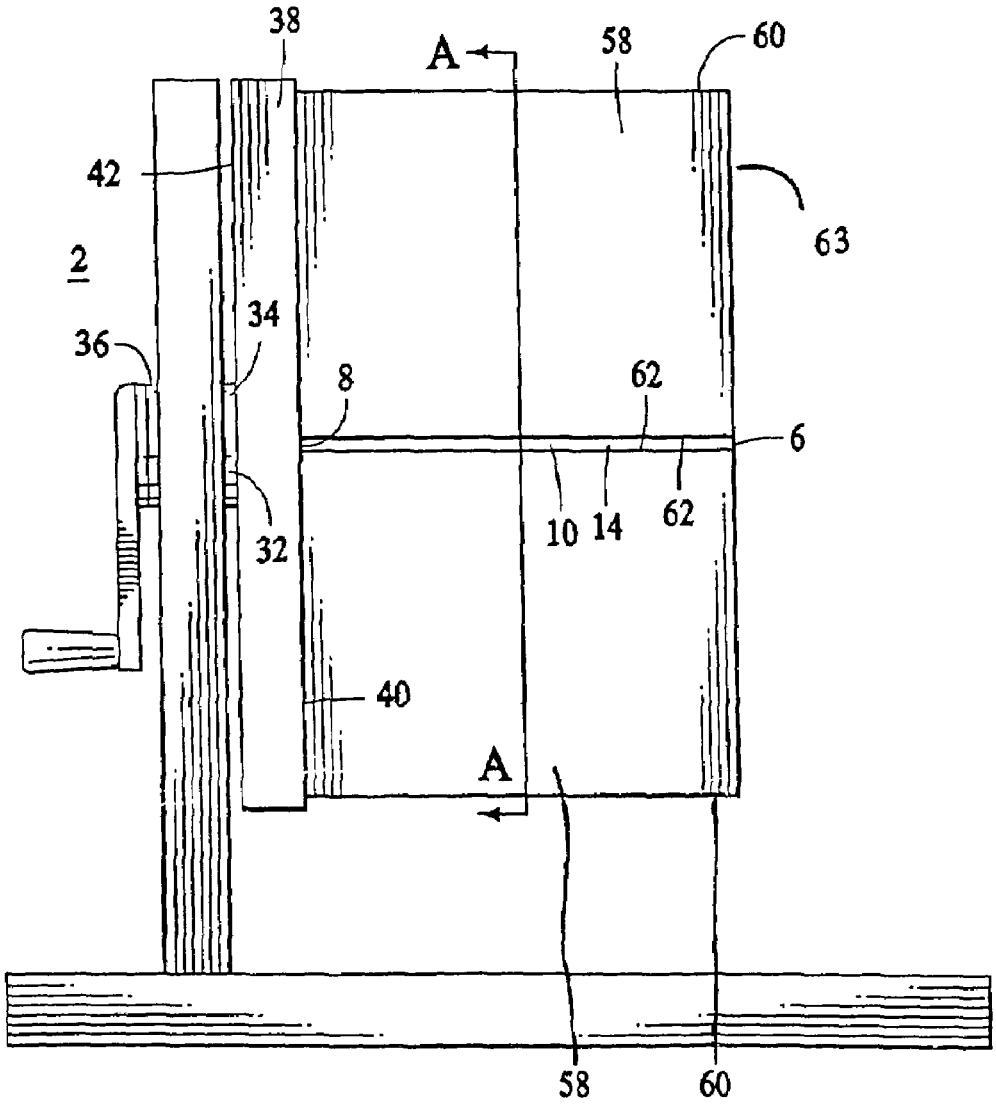
FIG. 1 is a side view of an embodiment.
Figure 2:
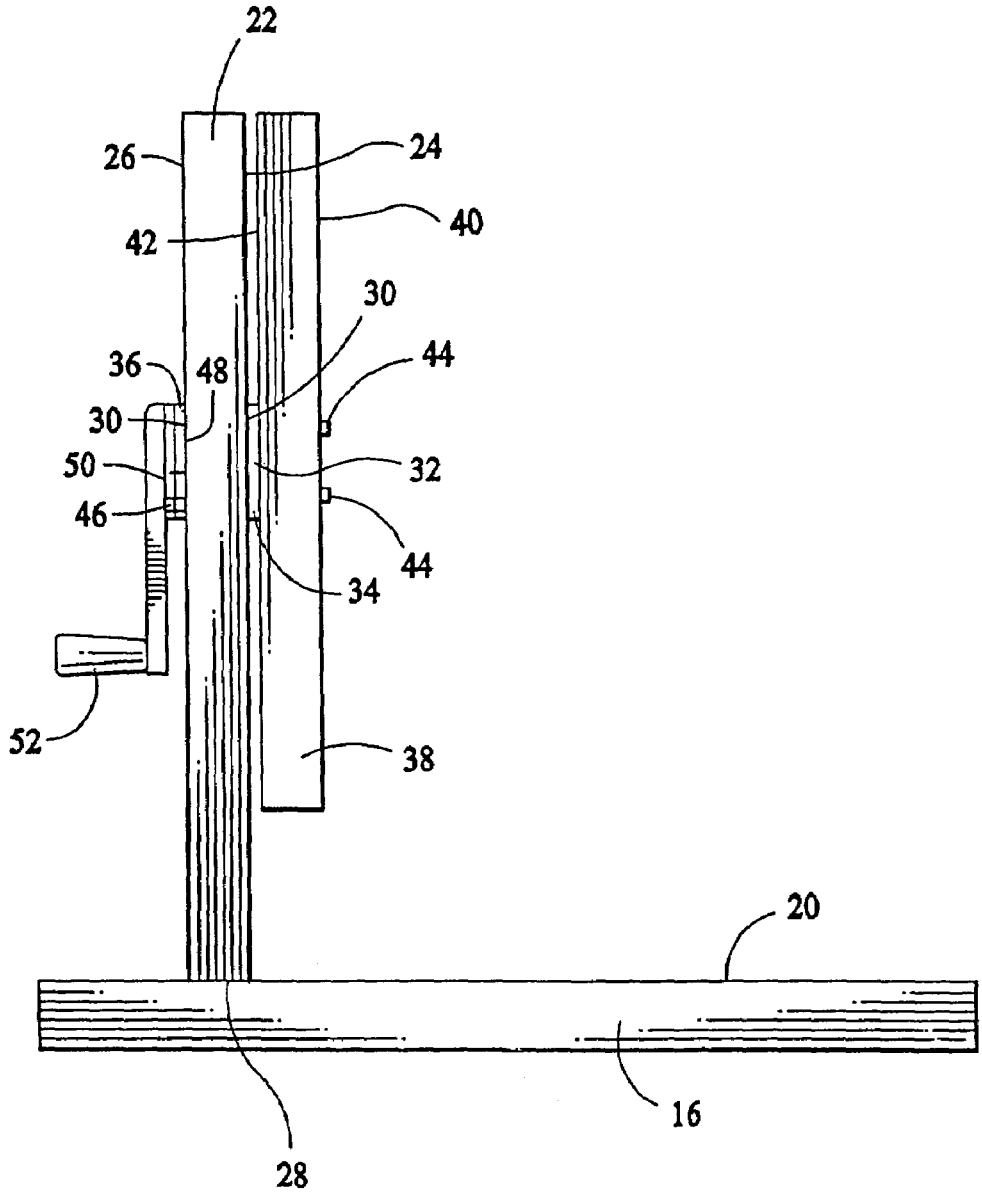
FIG. 2 is a side view of an embodiment of FIG. 1 with the heatsinks removed.
Figure 3:
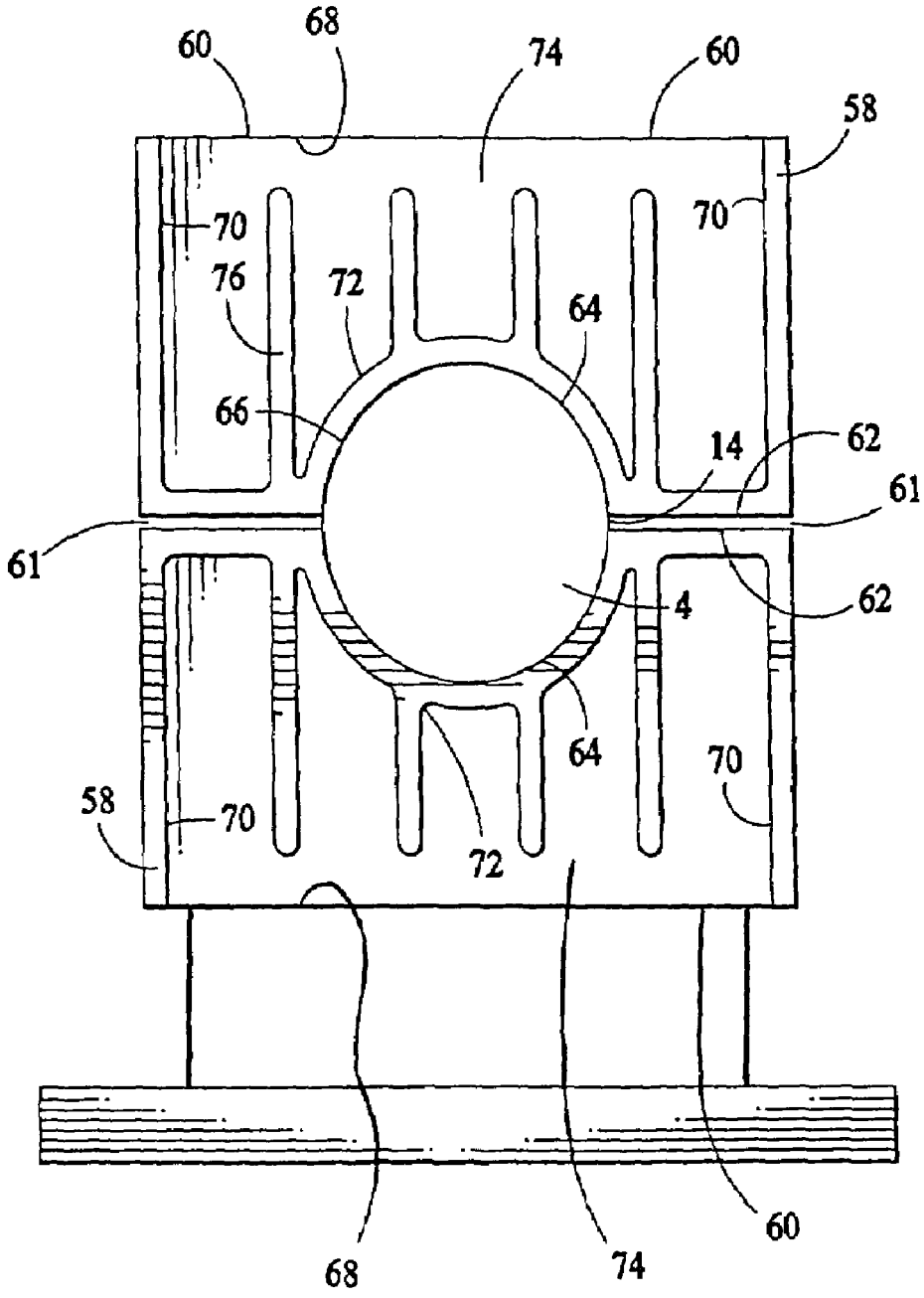
FIG. 3 is a front sectional view of an embodiment taken along the line A-A of FIG. 1.

FIGS. 1-3 generally illustrate an embodiment of the liquid cooler 2. A novel liquid cooler 2 to cool liquid in a container 4 is described below. The container 4 has a top side 6, a bottom side 8, and a peripheral boundary 10 connecting the top side 6 and bottom side 8. The peripheral boundary 10 of the container 4 includes an outer surface 14. The container 4 may be made of glass, aluminum, plastic, or any other type of material typically used to hold liquid. The container 4 may be a commonly available product, such as a can or bottle of beer, soda, or juice. By way of another example, the container 4 may also be a commonly available cleaning agent, chemical, or solvent.

The liquid cooler 2 has a base 16. The base 16 includes a top surface 20 and a sidewall 22 having a first surface 24 and a second surface 26. Preferably, a bottom face 28 of the sidewall 22 is attached with the top surface 20 of the base 16. Protruding from a through-going opening 30 in the first surface 24 and second surface 26 of the sidewall 22 is a shaft 32. The shaft 32 has a first end 34 that protrudes from the portion of the opening 30 in the first surface 24, and a second end 36 that protrudes from the portion of the opening 30 in the second surface 26.

A rotating connector 38 having a front side 40 and a rear side 42 is attached with the first end 34 of the shaft 32. The rotating connector 38 is attached with the first end 34 of the shaft 32, preferably by having screws 44 passing through the front side 40 and the rear side 42 of the rotating connector 38 and fastening the rear side 42 of the rotating connector 38 to the first end 34 of the shaft 32.

A rotating mechanism 46 having an inner side 48 and an outer side 50 is attached with the second end 36 of the shaft 32. Preferably, the rotating mechanism 46 is a conventional bearing or gear assembly. A handle 52 is connected with the outer side 50 of the rotating mechanism 46, and provides for direct rotation of the shaft 32.

Two heatsinks 58, each having a top side 60, a bottom side 62, and a front side 63 are connected with the front side 40 of the rotating connector 38. The heatsinks 58 preferably are removably connected with the front side 40 of the rotating connector 38, but they can also be affixed to the rotating connector 38. Preferably, the heatsink 58 is made from a conductive material, such as aluminum. However, in other embodiments other types of materials may also be used, such as plastics.

The bottom side 62 of the heatsink 58 has an inner portion 64. The inner portion 64 is formed to be substantially adjacent to and in contact with the peripheral boundary 10 of the container 4. When attached with the rotating connector 38, the heatsinks 58 are oriented to form a container receiver 66 that surrounds a container 4 when a container 4 is placed therein.

In other embodiments, an outer covering may be attached with the rotating connector so that it surrounds the heatsinks. The heatsinks are oriented in the outer covering to form the container receiver described above, and are removable with respect to the outer sheet. Insulation may be placed between the heatsinks and the outer covering.

An inwardly facing wall 68 of the top side 60, a pair of interior sidewalls 70, and an interior bottom wall 72 define a cavity 74 within the heatsink 58. The cavity 74 holds a cooling substance, such as ice or conventional gel or "cold packs." The interior bottom wall 72 of the cavity 74 is formed to be adapted to the shape of the bottom side 62 of the heatsink 58.

Referring to FIG. 3, the interior bottom wall 72 of the cavity 74 preferably is defined by a series of heat fins 76 which have been formed in the interior bottom wall 72. However, other embodiments of the invention can have the heatsink without an interior bottom wall adapted to include heat fins.

The top side 60 of the heatsink 58 is removable, and allows the cooling substance to be removed from and placed into the cavity 74. However, in other embodiments, the top side may be non-removable with respect to the heatsink. In yet another embodiment of a heatsink with a non-removable top side, a drain hole may be put in the heatsink to allow the cooling substance to be removed from and placed into the cavity. Alternatively, the heatsinks may be utilized without a cooling substance.

The operation of the liquid cooler is as follows: The heatsinks 58, with or without a cooling substance, preferably are removed from a freezer where they have been stored. The heatsinks 58 are then connected with the front side 40 of the rotating connector 38. For liquid coolers that use an outer covering, the heatsinks will be placed within the outer covering and will be oriented to form the container receiver 66. A container 4 is placed into the container receiver 66 so that the container 4 lies along its longitudinal axis in the container receiver 66.

When the container 4 is in the container receiver 66, the inner portion 64 of the bottom side 62 of the heatsink 58 should contact the outer surface 14 of the container 4. Preferably, however, there should be a nominal clearance 61 between the bottom sides 62 of the heatsinks 58 so that they do not contact each other. While this clearance 61 is not necessary for the operation of the liquid cooler 2, having this clearance 61 will prevent interference between the container 4 and the heatsinks 58. The clearance 61 will also increase the force exerted on the container 4, allowing for greater conductivity between the cooling substance in the cavity 74 and the liquid in the container 4.

The handle 52 is then used to rotate the heatsinks 58 and the container 4 within the container receiver 66. While the container 4 is being rotated, different portions of the liquid within the container 4 are circulated towards the peripheral boundary 10 of the container 4. The inner portion 64 of the heatsink 58, cooled by the cooling substance within the cavity 74 of the heatsink 58, will cool the liquid in the container 4 as it circulates towards the peripheral boundary 10. The heat fins 76 in the cavity 74 allow for a high level of conductivity between the cooling substance in the cavity 74 and the liquid in the container 4.

Because different portions of the warm liquid are continuously being circulated towards the peripheral boundary 10 of the container 4, a large temperature gradient is maintained between the cooling substance in the cavity 74 and liquid in the container 4. The large temperature gradient allows the liquid in the container 4 to be cooled in less than one minute.

Once the liquid in the container 4 is cooled, rotation is stopped and the container 4 is removed from the container receiver 66.

While the embodiments of the invention disclosed herein are presently considered to be preferred, various changes and modifications can be made without departing from the spirit and scope of the invention. For example, in other embodiments of the invention there may be a different number of heatsinks. More than two heatsinks may be connected with the front side of the rotating connector, with the heatsinks oriented to form a container receiver as previously described. Alternatively, one heatsink may be used.

Figure 4:
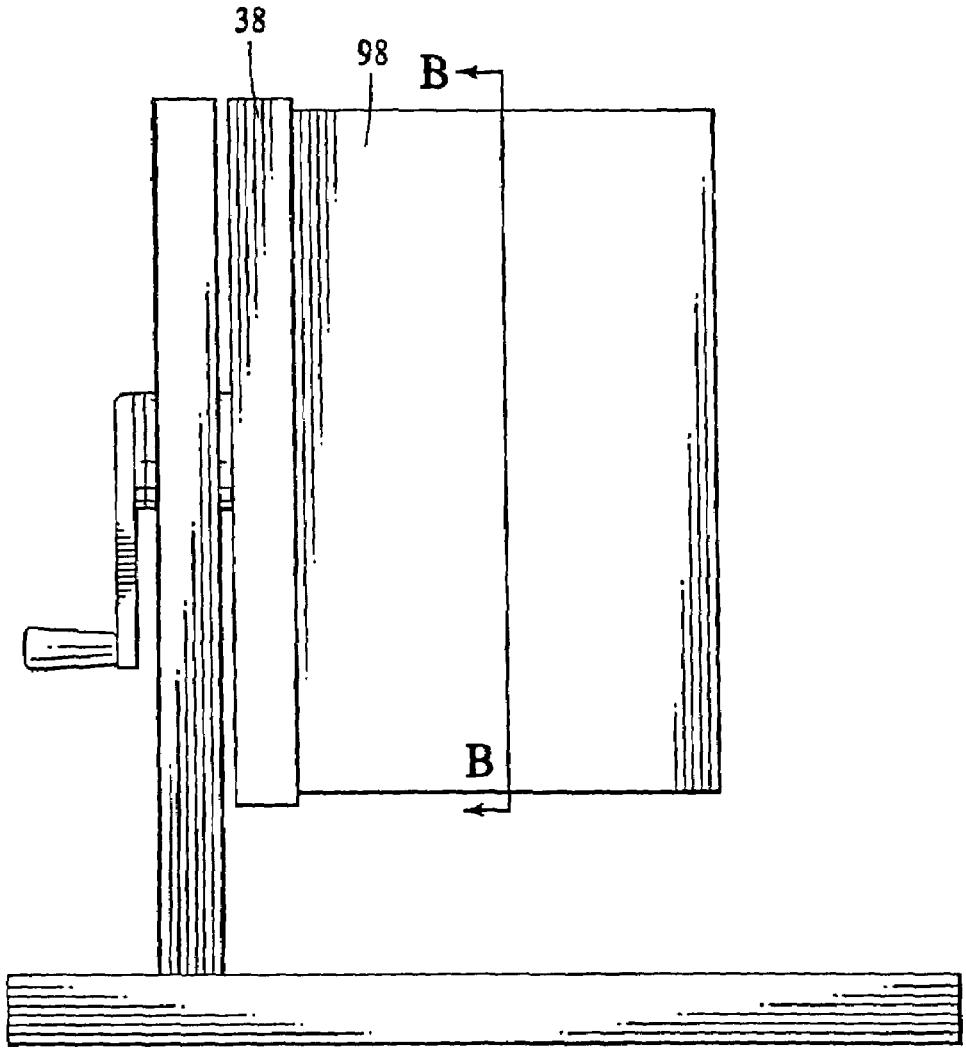
FIG. 4 is a side view of another embodiment showing a block.
Figure 5:
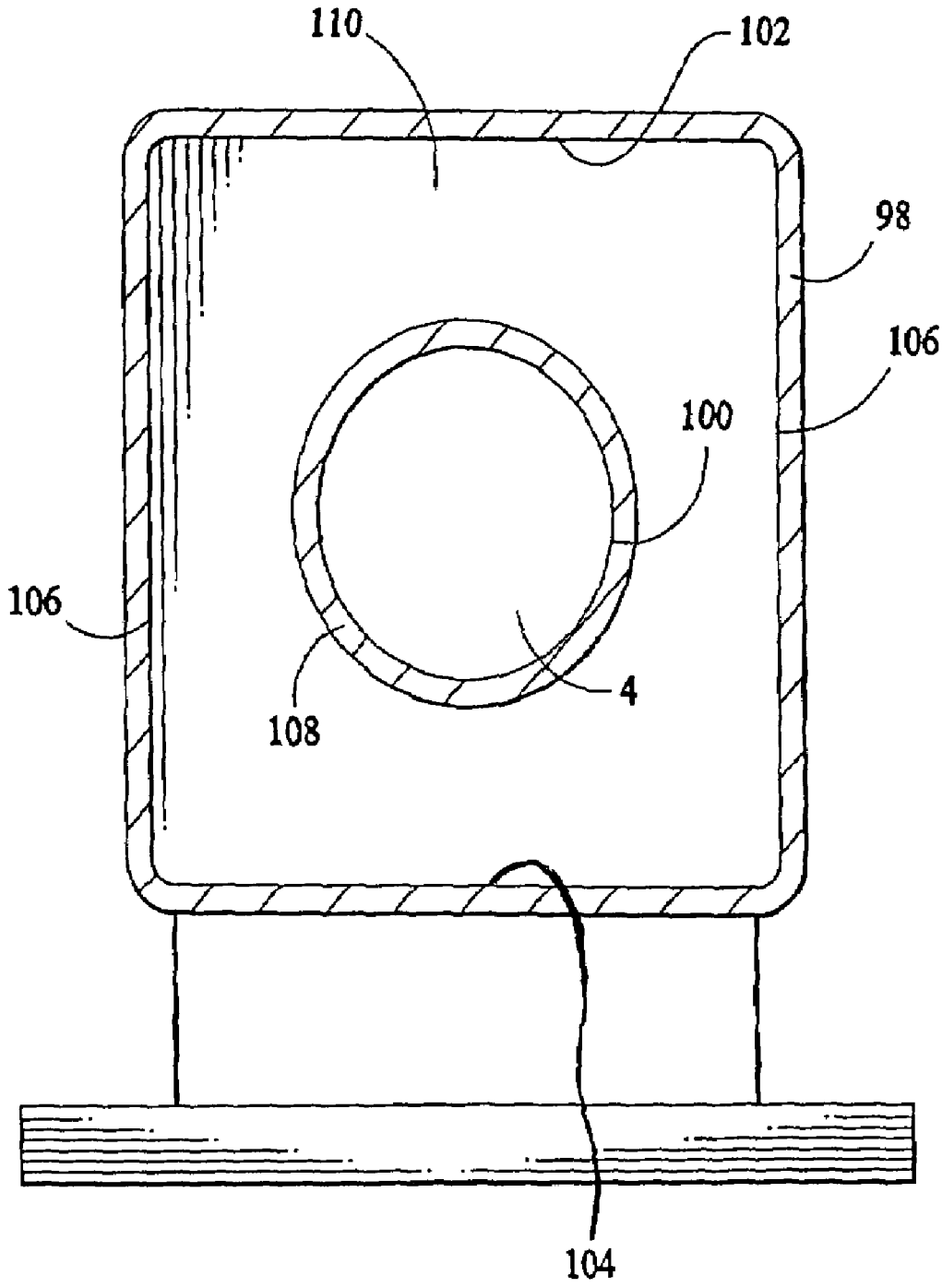
FIG. 5 is a front sectional view of an embodiment taken along the line B-B of FIG. 4.

As shown in FIGS. 4 and 5, in another embodiment there may be one block 98 attached with the rotating connector 38. Passing through the block 98 is a cutout 100 adapted to surround and receive a container 4. An interior upper wall 102, an interior lower wall 104, a pair of interior sidewalls 106, and an inside wall 108, formed to surround the cutout 100, define a cavity 110 in the block. As with the cavity 74 in the heatsink 58 previously described, the cavity 110 in the block 98 may hold a cooling substance. Heat fins, as described above, may be used to define the inside wall 108 of the cavity 110, but are not necessary.

Figure 6:
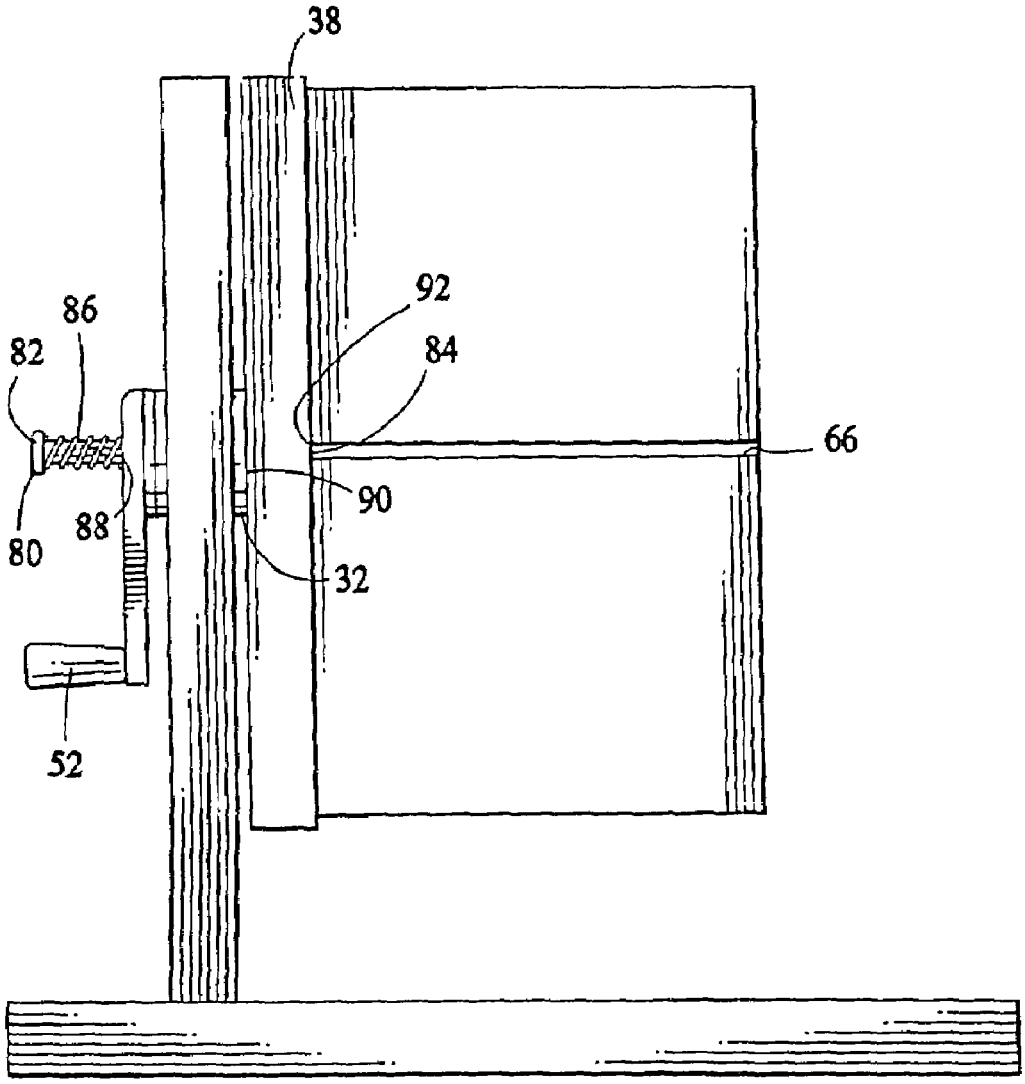
FIG. 6 is a side view of an embodiment of FIG. 1 showing an ejecting member.

As shown in FIG. 6, another embodiment of the liquid cooler 2 also incorporates an ejecting member 80 for removing the container 4 from the container receiver 66. The ejecting member 80 has a first end 82 and a second end 84, and preferably incorporates a spring 86 so that the ejecting member 80 is spring-loaded. In a preferred embodiment, the first end 82 of the ejecting member 80 protrudes from a cutout 88 in the handle 52. The second end 84 of the ejecting member 80 passes through an opening 90 in the shaft 32, and protrudes from a cutout 92 in the rotating connector 38.

Operation of the ejecting member 80 is as follows: once a container 4 has been cooled as described above, the first end 82 of the ejecting member 80 is depressed. While the first end 82 of the ejecting member 80 is depressed, the second end 84 will contact the container 4 and dislodge the container 4 from the container receiver 66 so that a portion of the container 4 protrudes from the container receiver 66. The first end 82 is then released, and the spring 86 returns the ejecting member 80 to its non-depressed position. The container 4 may then be removed from the container receiver 66.

Note that in additional embodiments that incorporate rotational devices other than a handle, described in more detail below, an ejected member may still be incorporated into the liquid cooler.

Figure 7:
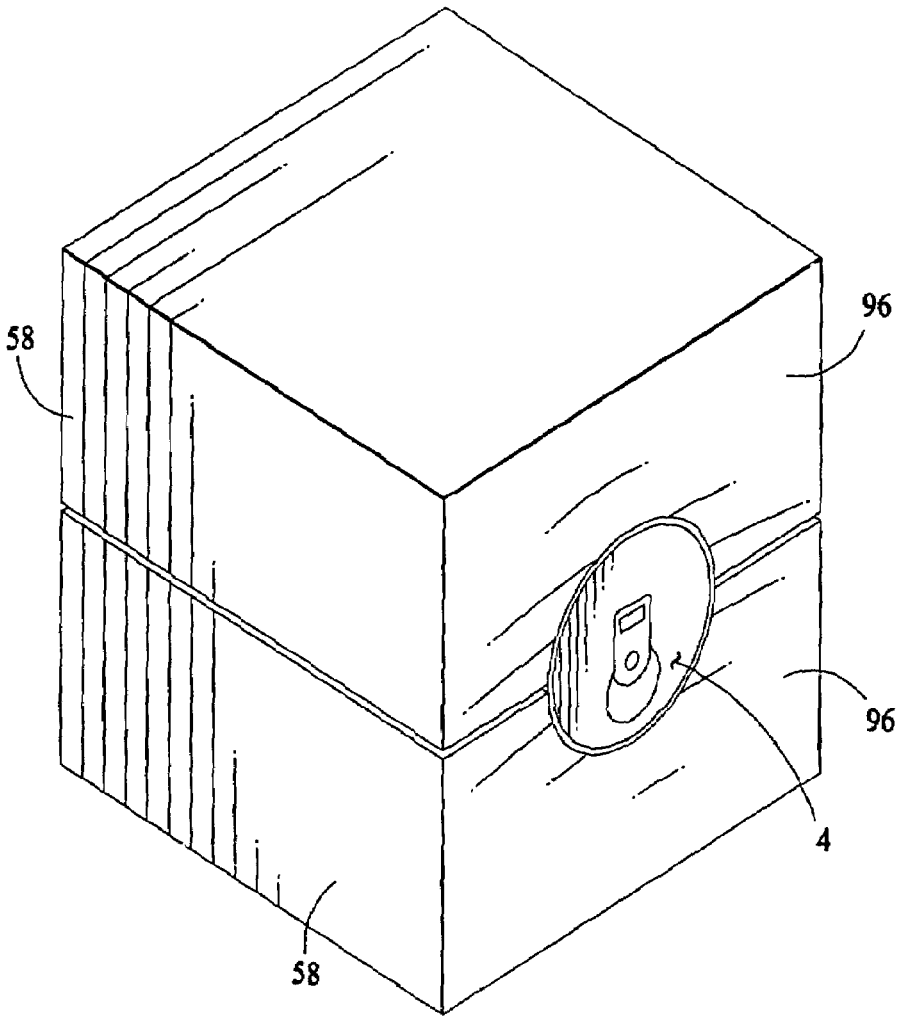
FIG. 7 is a perspective view of two heatsinks and a container with the heatsinks each having a membrane.

Referring now to FIG. 7, another embodiment of the invention incorporates a flexible membrane 96 for use with liquid coolers that utilize a cooling substance. The membrane 96 allows for expansion of the cooling substance. Preferably, a membrane 96 is used in lieu of the front face of the heatsink 58, although in other embodiments the membrane may be used in lieu of the front and bottom faces of the heatsink. The membrane 96 allows for thermal variations in the cooling substance, allowing the cooling substance to expand, and thereby preventing the heatsink from cracking. As shown in FIG. 7, when a container 4 is placed into the container receiver 66, the membrane 96 will flex to conform to the shape of the container. The membrane may be any suitable material having sufficient strength such as, by way of example, latex, plastic, or urethanes.

In an alternative embodiment, a pressure relief valve may be used instead of a membrane. The pressure relief valve is a one-way valve located on the heatsink that allows gases to exit from the heatsink but which retains liquid. The pressure relief valve would prevent expansion of the cooling substance, and, as with the membrane, would prevent the heatsink from cracking.

In other embodiments, different devices and configurations can be used to rotate the heatsinks. For example, instead of using a handle connected with a shaft to rotate the heatsinks, a handle may be connected with one of the heatsinks. Alternatively, a motor assembly may be connected with the rotating connector, allowing for motorized rotation of the liquid cooler. A conventional electrical cord, inserted into an electrical outlet, may supply power to the motor assembly. Rotation may also be accomplished using battery power, such as through the use of a push button on the liquid cooler or by plugging the liquid cooler into a battery source such as a cigarette lighter in an automobile. In yet additional embodiments, rotation may be accomplished using solar power.

Figure 8:
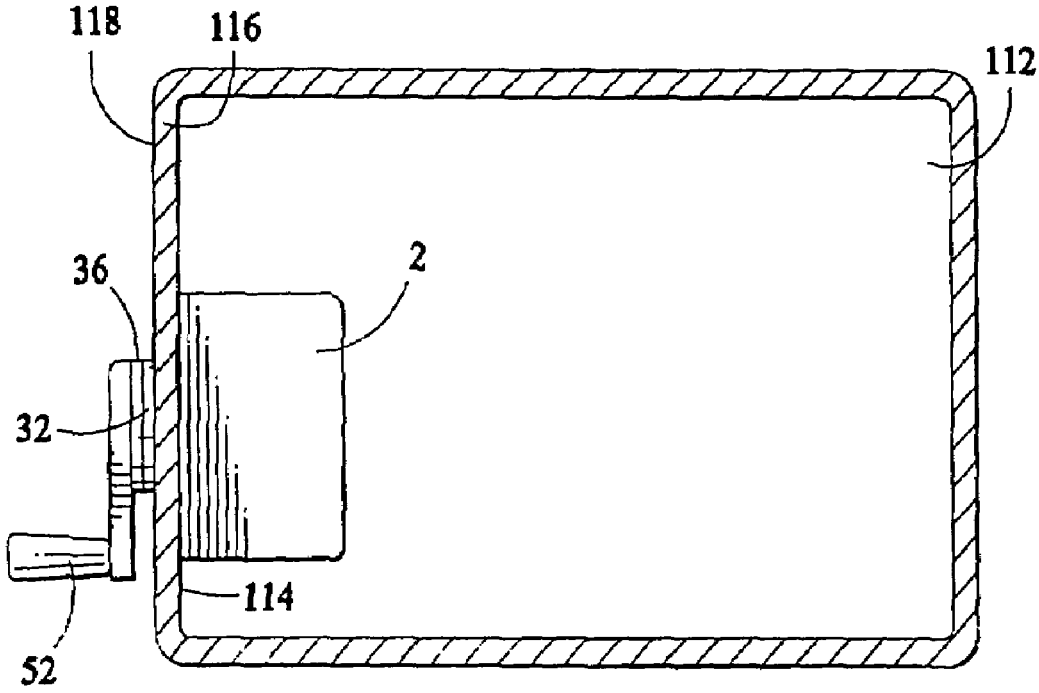
FIG. 8 is a side view of an embodiment of the liquid cooler incorporated into a recreational product, with the sidewall of the recreational product removed.
Figure 9:
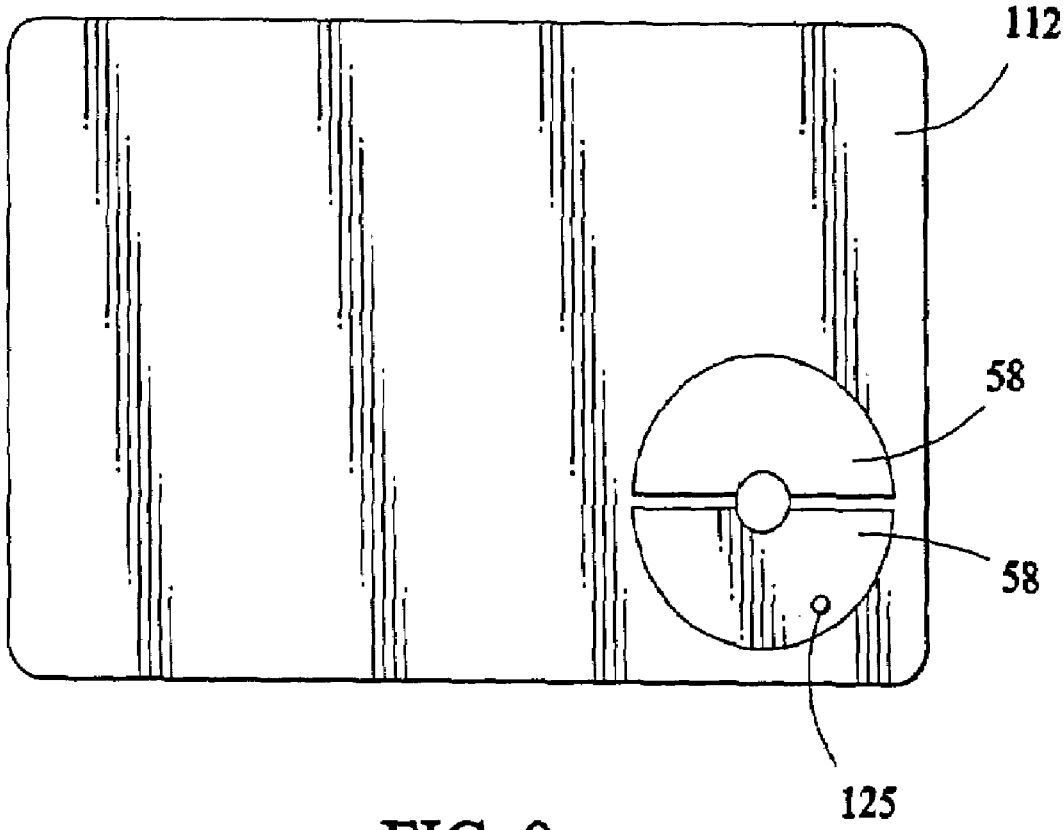
FIG. 9 is a top view of an embodiment of the liquid cooler incorporated into a recreational product, with the liquid cooler configured to face upwardly.

As shown in FIG. 8, another embodiment of the invention allows the liquid cooler 2 to be incorporated into a recreational product 112 such as a transportable picnic cooler. For example, instead of utilizing the base 16, the second end 36 of the shaft 32 may be incorporated into a first side 114 of a wall 116 of the recreational product 112 so that the second end 36 protrudes from a second side 118 of the wall 116 of the recreational product 112. The handle 52 may then be attached with the second end 36 of the shaft 32. Operation of the liquid cooler 2 is as described above. FIG. 9 shows an additional embodiment of the liquid cooler 2 incorporated into a recreational product 112. The liquid cooler 2 is oriented so that the container receiver 66 faces upwardly and preferably is operated via a pushbutton 125 on a heatsink 58. However, any of the rotational methods described above may be used.

Figure 10:
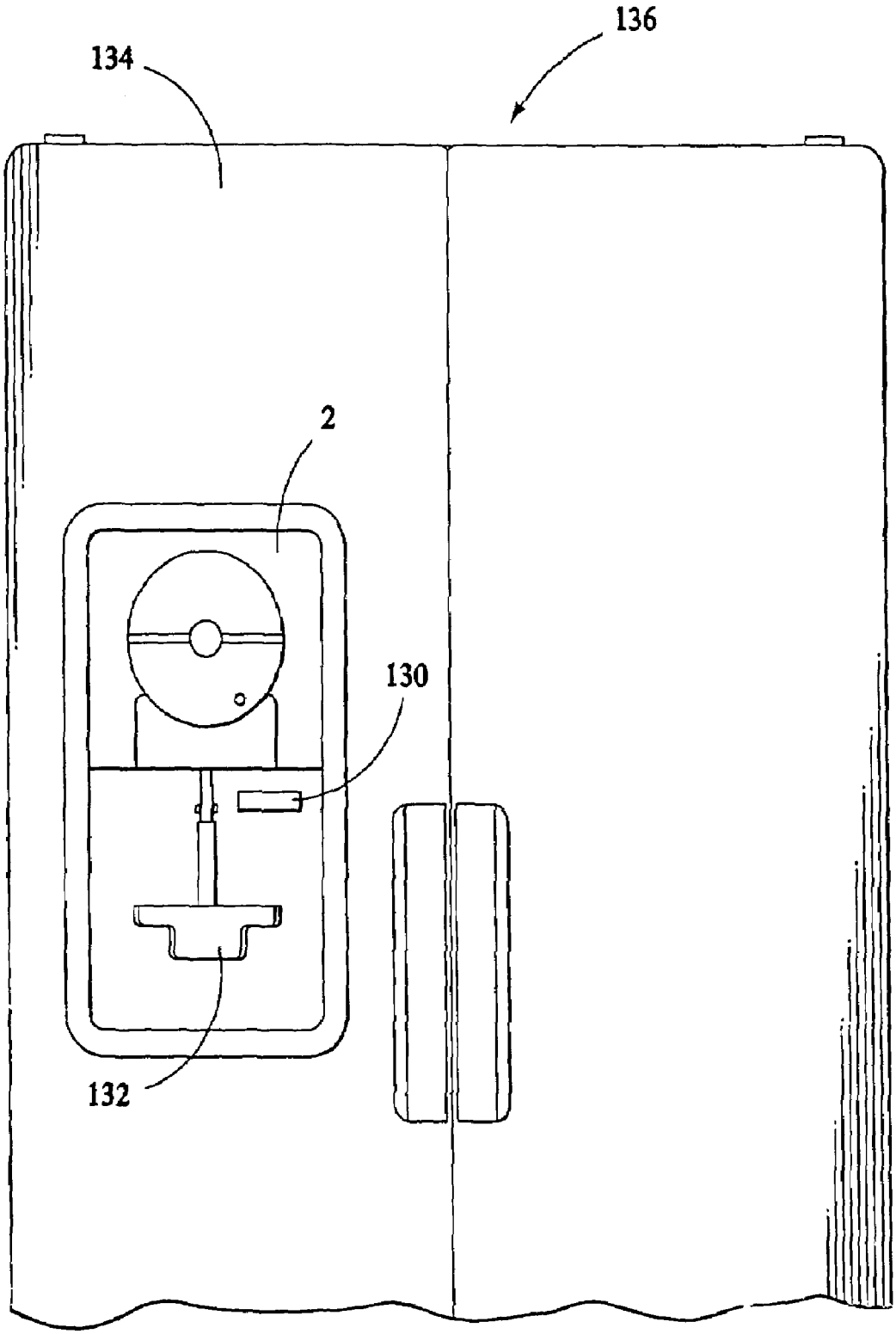
FIG. 10 is a front view of the liquid cooler incorporated into the freezer door of a refrigerator-freezer.

FIG. 10 illustrates the liquid cooler 2 incorporated in the door of a refrigerator-freezer 136. Conventional refrigerator-freezers often will have a water dispenser and an icemaker located on a freezer door. As shown in FIG. 10, the liquid cooler 2 may be incorporated into freezer door 134 with a water dispenser 130 and an icemaker 132. Of course, the liquid cooler may also be incorporated into a freezer door alone.

The advantages of the above-described embodiments of the invention are numerous. For example, by having the heatsinks removably attached with the rotating connector, they can easily be stored in a freezer without taking up space. When used to cool a container, they may be removed from the freezer for use with the liquid cooler. Furthermore, because the liquid cooler allows for the rapid cooling of containers, refrigerated space need not be wasted storing a plurality of cans. This is especially useful for smaller refrigerators, such as those commonly found in college dormitories.

Another advantage of the present embodiments is not having the cooling substance in direct contact with the container. The container will not become wet or soiled, and therefore will be easier to handle.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A refrigerator-freezer comprising: a freezer door including a liquid cooler for cooling a container, said liquid cooler having a housing, at least one heatsink attached with said housing, said heatsink having a top wall with an inwardly facing wall, a bottom wall with an inner surface formed to surround and contact a portion of an outer surface of said container, interior sidewalls and an interior lower wall, said inwardly facing wall, said interior sidewalls, and said interior lower wall defining a cavity, wherein said interior lower wall of said cavity includes at least one heat fin, said liquid container further including an outer covering attached with said housing that surrounds said heatsink, a pushbutton for rotating said heatsink and said outer covering, and an ejector button for removing said container from said heatsink.

2. The refrigerator-freezer of claim 1, wherein said outer covering is insulated.

3. The refrigerator-freezer of claim 1, wherein said heatsink comprises aluminum.

4. The refrigerator-freezer of claim 1, wherein said heatsink further comprises a plastic material.

5. The refrigerator-freezer of claim 1, wherein said heatsink comprises a pressure relief valve.

6. An apparatus for rapidly cooling the liquid contents of a container, the apparatus comprising:

a block having an inner space configured to receive the container and to surround and contact a major portion of the outer surface of the container, the block being substantially comprised of a material having high thermal conductivity;

cooling means for reducing the temperature of the block, the cooling means having a housing connected to the block; and rotating means connected to the housing for rotating the block and the container about the longitudinal axis of the container, whereby the liquid contents of the container are rapidly cooled via heat transfer to the block when the block has been previously made cold.

7. The apparatus of claim 6, wherein said block has at least one inner wall that is flexible so as to conform to containers having different shapes.

8. The apparatus of claim 7, wherein said inner wall includes a flexible membrane comprised of a material selected from the group of latex, plastic, and urethane.

9. The apparatus of claim 6, wherein said block includes an enclosed interior cavity adapted for containing a cooling substance.

10. The apparatus of claim 9, wherein said block includes a plurality of heat fins protruding into the interior cavity.

11. The apparatus of claim 6, wherein said rotating means includes an electric motor.

12. The apparatus of claim 6, wherein said rotating means includes a handle configured for the user to manually rotate.

13. The apparatus of claim 6, wherein said cooling means is a freezer.

14. The apparatus of claim 6, wherein said cooling means is a portable cooler.

15. A freezer for rapidly chilling the liquid contents of a substantially cylindrically shaped beverage container having a first temperature, the freezer adapted to lower its interior temperature to a second temperature substantially below the first temperature, the freezer comprising:

an external wall having an outside surface accessible to a user and an inside surface disposed on the interior of the freezer;

a block having a substantially cylindrically shaped inner space configured to receive the beverage container and to surround and directly contact a major portion of the outer surface of the container, the block being substantially larger than the container and being substantially comprised of a conductive material;

mounting means for coupling the block to the external wall such that the majority of the block is disposed on the interior of the freezer and such that a beverage container can be placed into the inner space of the block from outside the freezer;

rotating means coupled to the mounting means for rotating the block and the container along the longitudinal axis of the container, whereby upon placing the beverage container within the inner space of the block and rotating the block and the container for a period of time, the liquid contents of the beverage container are chilled via heat transfer from the beverage to the block.

16. The apparatus of claim 15, wherein the inner surface of the inner space of the block includes a flexible membrane comprised of a material selected from the group of latex, plastic, and urethane.

17. The apparatus of claim 15, wherein said rotating means includes an electric motor configured to continuously rotate the block and container.

18. The apparatus of claim 15, wherein said block includes an enclosed interior cavity adapted for containing a cooling substance.

19. The apparatus of claim 15, wherein the inner space of the block is configured to surround and contact substantially all of the outer surface of a cylindrically shaped 12 ounce beverage can.

* * * * *